US011551897B2

(12) United States Patent
Zhang et al.

(10) Patent No.: US 11,551,897 B2
(45) Date of Patent: Jan. 10, 2023

(54) ELECTROMAGNETIC SYSTEM

(71) Applicant: Tyco Electronics (Shenzhen) Co. Ltd., Shenzhen (CN)

(72) Inventors: Xiaoning Zhang, Shenzhen (CN); Teng Zou, Shenzhen (CN)

(73) Assignee: Tyco Electronics (Shenzhen) Co. Ltd., Shenzhen (CN)

( * ) Notice: Subject to any disclaimer, the term of this patent is extended or adjusted under 35 U.S.C. 154(b) by 125 days.

(21) Appl. No.: 16/720,206

(22) Filed: Dec. 19, 2019

(65) Prior Publication Data

US 2020/0126746 A1 Apr. 23, 2020

Related U.S. Application Data

(63) Continuation of application No. PCT/EP2018/065774, filed on Jun. 14, 2018.

(30) Foreign Application Priority Data

Jun. 21, 2017 (CN) ..... 201710478049.1

(51) Int. Cl.
*H01H 50/36* (2006.01)
*H01H 50/24* (2006.01)
*H01F 7/14* (2006.01)

(52) U.S. Cl.
CPC ..... *H01H 50/36* (2013.01); *H01F 7/145* (2013.01); *H01H 50/24* (2013.01)

(58) Field of Classification Search
CPC ..... H01F 7/145; H01H 50/24; H01H 50/20; H01H 50/30; H01H 50/16; H01H 50/36
See application file for complete search history.

(56) References Cited

U.S. PATENT DOCUMENTS 2,566,571 A * 9/1951 Leland ..... H02K 7/065 74/89
2,966,064 A * 12/1960 Courtney ..... H01F 7/145 74/89

(Continued)

FOREIGN PATENT DOCUMENTS

JP 61-208204 A 9/1986

OTHER PUBLICATIONS

PCT Notification, The International Search Report and the Written Opinion of the International Searching Authority dated Oct. 18, 2018, 15 pages.

(Continued)

*Primary Examiner* — Bernard Rojas
(74) *Attorney, Agent, or Firm* — Barley Snyder

(57) ABSTRACT

An electromagnetic system includes a magnetic yoke, a coil mounted in the magnetic yoke, a lower iron core disposed in a lower portion of the coil, a top plate disposed above the coil, an upper iron core having a lower portion disposed in the coil and an upper portion extending through the top plate, an armature disposed above the top plate and fixedly connected to the upper iron core, a magnetic isolation ring disposed between the upper iron core and the top plate, and a plurality of balls each rolling in one of a plurality of first curved grooves of the armature and one of a plurality of second curved grooves of the top plate. The upper iron core moves in a vertical direction. A force applied on the armature by the ball is inclined to a central axis of the upper iron core to drive the armature to rotate.

20 Claims, 5 Drawing Sheets

(56) References Cited

U.S. PATENT DOCUMENTS

| | | | | | |
|---|---|---|---|---|---|
| 3,264,530 | A * | 8/1966 | Leland | H02K 7/065 | 74/99 R |
| 3,308,410 | A * | 3/1967 | Biser | F16H 25/186 | 74/88 |
| 3,743,987 | A * | 7/1973 | Yost | H01F 7/145 | 335/228 |
| 4,157,521 | A * | 6/1979 | Leland | H01F 7/145 | 335/228 |
| 4,470,030 | A | 9/1984 | Myers | | |
| 4,660,010 | A * | 4/1987 | Burton | H01F 7/145 | 335/228 |
| 2021/0027963 | A1* | 1/2021 | Zhang | H01H 9/443 | |

OTHER PUBLICATIONS

Abstract of JP 61-208204, dated Sep. 16, 1986, 1 page.

* cited by examiner

ELECTROMAGNETIC SYSTEM

CROSS-REFERENCE TO RELATED APPLICATIONS

This application is a continuation of PCT International Application No. PCT/EP2018/065774, filed on Jun. 14, 2018, which claims priority under 35 U.S.C. § 119 to Chinese Patent Application No. 201710478049.1, filed on Jun. 21, 2017.

FIELD OF THE INVENTION

The present invention relates to an electromagnetic system and, more particularly, to a rotary electromagnetic system.

BACKGROUND

An electromagnetic system is an excitation mechanism, and generally includes an iron core, an armature, a magnetic yoke, and a coil. After being energized, the coil generates magnetic flux that passes through a magnetic circuit formed by the iron core, the armature, and the magnetic yoke. The air gap in the magnetic circuit generates a force, thereby converting electrical energy into mechanical energy.

Common electromagnetic systems may be classified into direct-acting electromagnetic systems and rotary electromagnetic systems. The direct-acting electromagnetic system has been widely used in contactors and relays due to its simple structure and reliable performance.

However, in some cases, the rotary electromagnetic system is required since it may eliminate unnecessary mechanisms such as motors, cams, cranks, connecting rods and the like. At present, the common rotary electromagnetic systems include ball-rotation rotary electromagnetic systems and inclined-rotation rotary electromagnetic systems. However, the two types of rotary electromagnetic systems each have their advantages and disadvantages; the ball-rotation rotary electromagnetic system may generate large torque but have unstable motion, while the inclined-rotation is relatively stable but generates smaller torque.

SUMMARY

An electromagnetic system includes a magnetic yoke, a coil mounted in the magnetic yoke, a lower iron core disposed in a lower portion of the coil, a top plate disposed above the coil, an upper iron core having a lower portion disposed in the coil and an upper portion extending through the top plate, an armature disposed above the top plate and fixedly connected to the upper iron core, a magnetic isolation ring disposed between the upper iron core and the top plate, and a plurality of balls each rolling in one of a plurality of first curved grooves of the armature and one of a plurality of second curved grooves of the top plate. The upper iron core moves in a vertical direction. A force applied on the armature by the ball is inclined to a central axis of the upper iron core to drive the armature to rotate.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
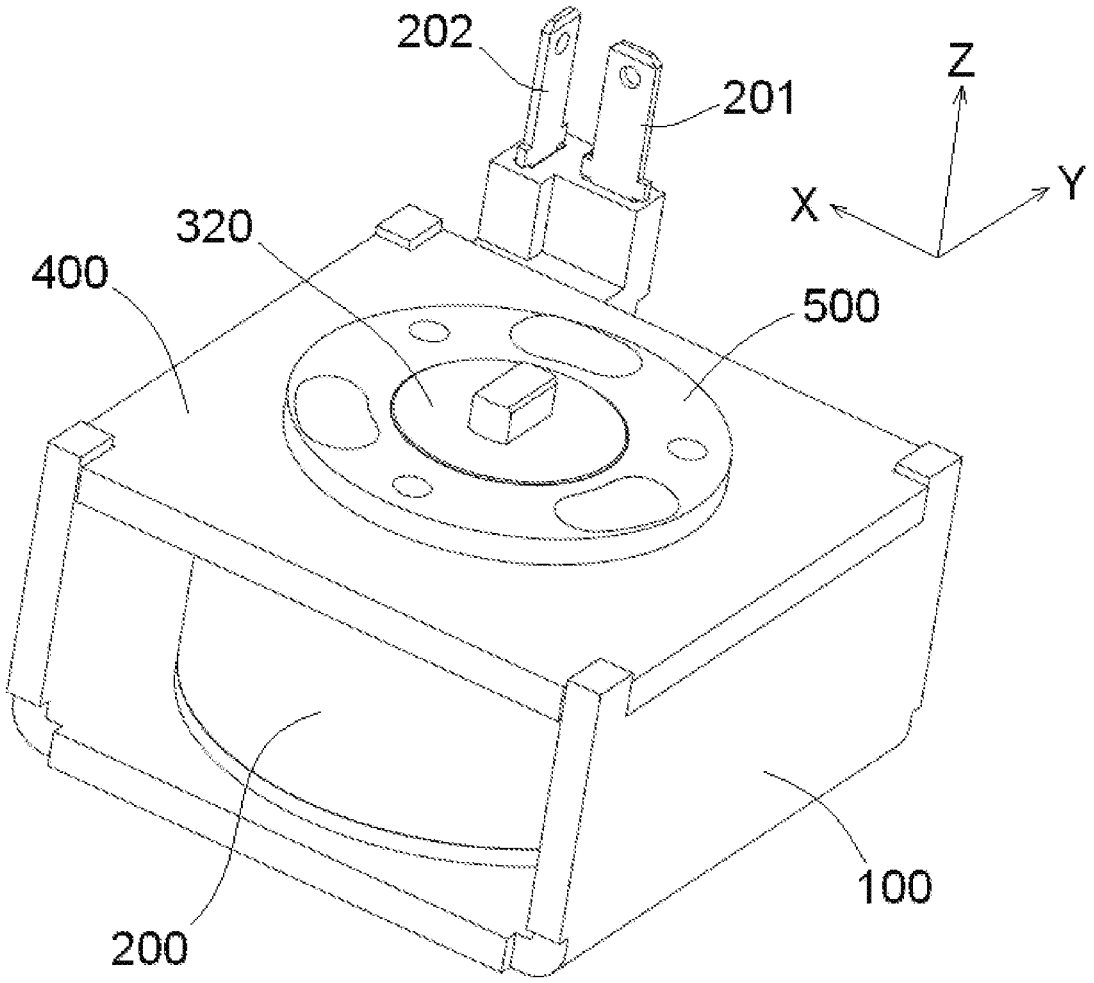
FIG. 1 is a perspective view of an electromagnetic system according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
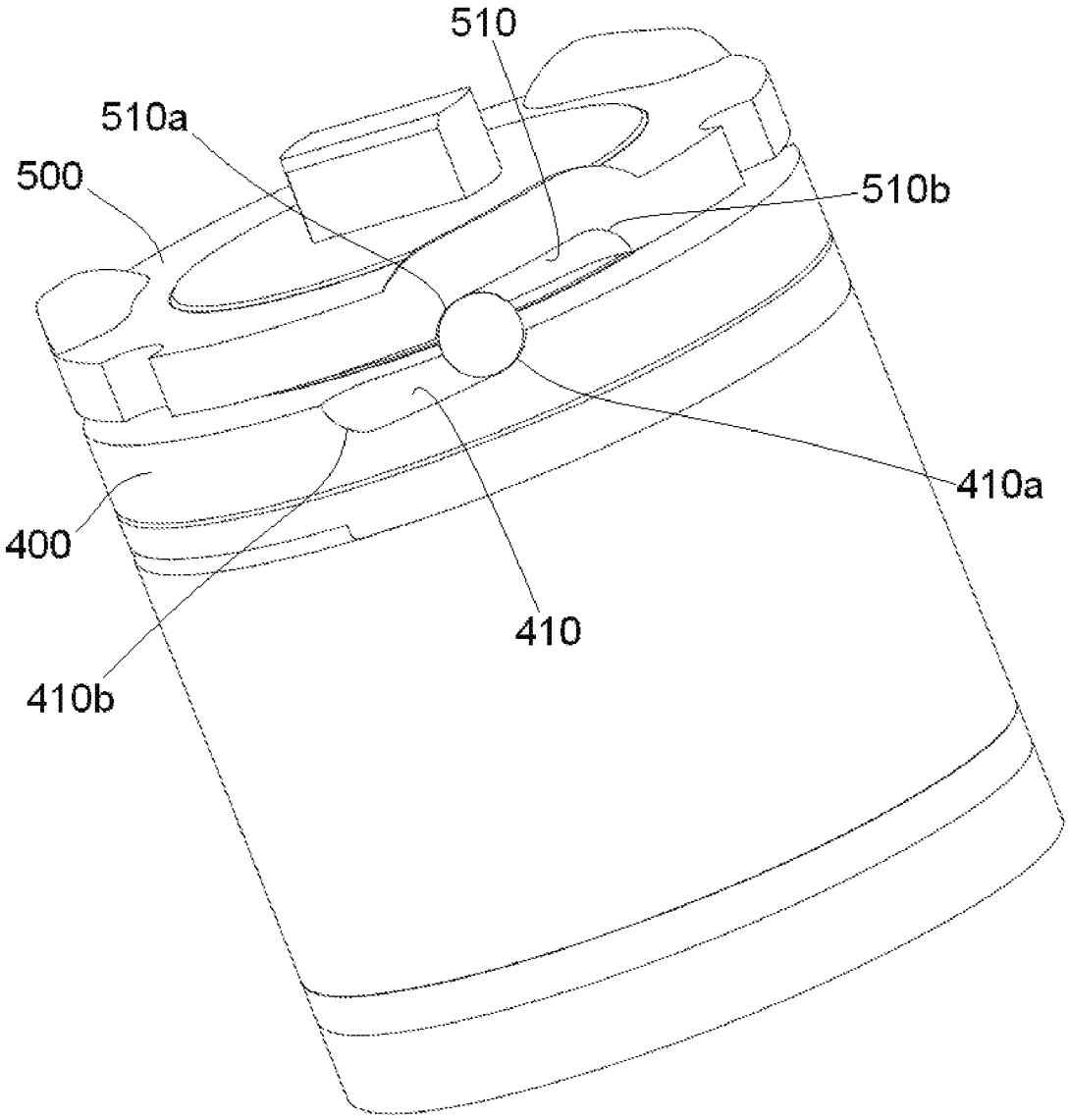
FIG. 2 is a perspective view of the electromagnetic system with portions of a top plate and an armature cut away and a magnetic yoke removed.
Figure 4:
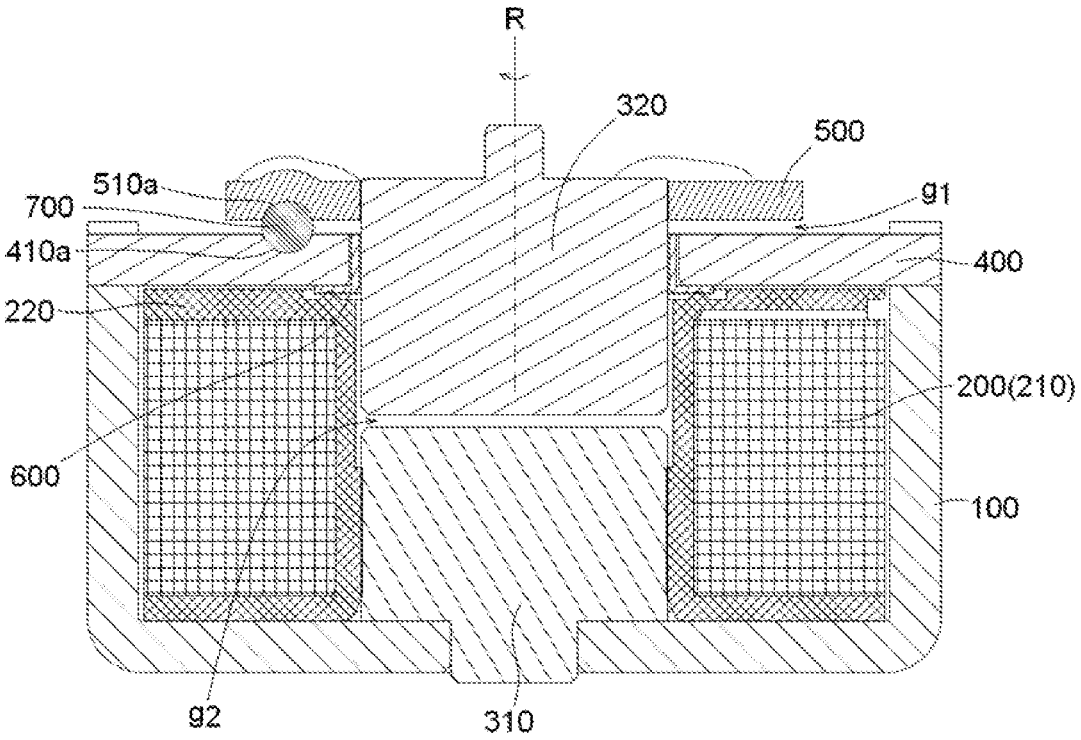
FIG. 4 is a sectional side view of the electromagnetic system with the armature in an initial position.

An electromagnetic system according to an embodiment, as shown in FIGS. 1, 2, and 4, comprises a magnetic yoke 100, a coil 200, a lower iron core 310, a top plate 400, an upper iron core 320, an armature 500, a magnetic isolation ring 600, and a plurality of balls 700. The coil 200 is mounted in the magnetic yoke 100. The lower iron core 310 is accommodated in a lower portion of the coil 200 and fixed to the magnetic yoke 100. The top plate 400 is located above the coil 200 and fixed to the magnetic yoke 100. A lower portion of the upper iron core 320 is accommodated in the coil 200, and an upper portion of the upper iron core 320 passes through the top plate 400. The armature 500 is located above the top plate 400 and fixedly connected to the top iron core 320. The magnetic isolation ring 600 is disposed between the upper iron core 320 and the top plate 400 such that the upper iron core 320 and the top plate 400 are electromagnetically separated from each other.

The upper iron core 320, as shown in FIGS. 1, 2, and 4, is movable up and down in a vertical direction Z with respect to the magnetic separation ring 600. A central axis R of the upper iron core 320 is parallel to the vertical direction Z.

A plurality of first curved grooves 510, as shown in FIGS. 2-5, are formed in a bottom surface of the armature 500, and a plurality of second curved grooves 410, corresponding to the plurality of first curved grooves 510 respectively, are formed in a top surface of the top plate 400. The plurality of first curved grooves 510 are evenly spaced around the central axis R of the upper iron core 320. Each of the first curved grooves 510 has a ball 700. The ball 700 rolls in the first curved groove 510 and the second curved groove 410. The ball 700, in various embodiments, may be a spherical ball or a cylindrical ball. A central axis of the plurality of first curved grooves 510 is coincided with the central axis R of the upper iron core 320.

Figure 3:
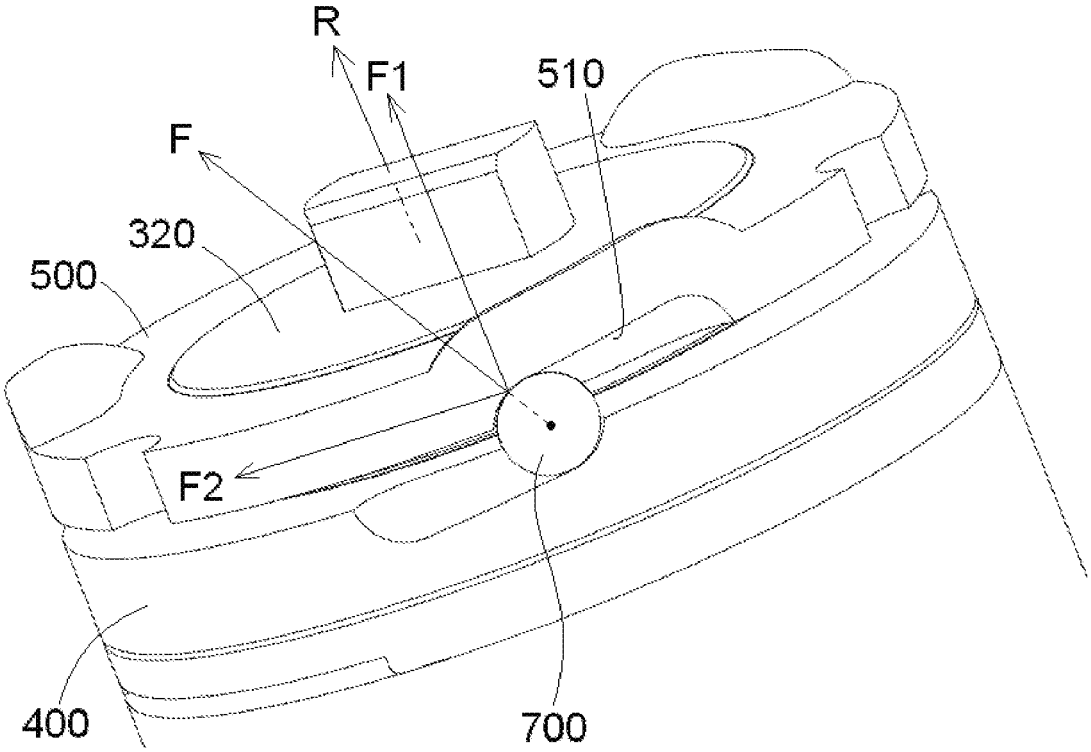
FIG. 3 is a schematic diagram of a force applied by a ball of the electromagnetic system on the armature shown in FIG. 2.

As shown in FIGS. 2-5, each first curved groove 510 has a depth gradually increasing from a first end 510*a* to a second end 510*b* of the first curved groove 510. A direction of a force F applied on the armature 500 by the ball 700, as shown in FIG. 3, is inclined with respect to the central axis R of the upper iron core 320. The force F applied to the armature 500 by the ball 700 has a first component force F1 parallel to the central axis R of the upper iron core 320 and a second component force F2 perpendicular to the central axis R of the upper iron core 320. The second component force F2 drives the armature 500 to rotate around the central axis R.

Figure 5:
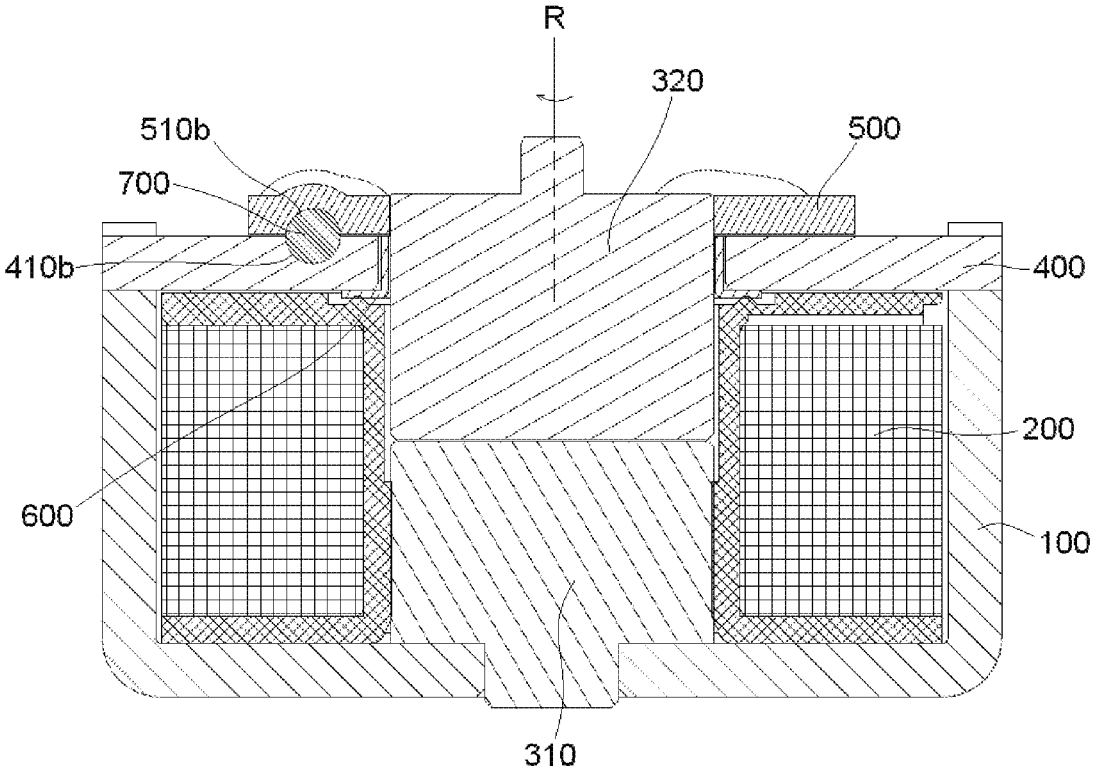
FIG. 5 is a sectional side view of the electromagnetic system with the armature in a final position.

The armature 500 is movable between an initial position, shown in FIG. 4, and a final position, shown in FIG. 5. When the armature 500 is moved from the initial position to the final position, the armature 500 is moved downward for a predetermined distance in the vertical direction Z while rotating for a predetermined angle around the central axis R. The armature 500 rotates around the central axis R for the predetermined angle which is equal to the sum of central angles of the first curved groove 510 and the second curved groove 410. That is, when the armature 500 is moved from the initial position to the final position, the armature 500 rotates around the central axis R for an arc length which is equal to the sum of arc lengths of the first curved groove 510 and the second curved groove 410 in the circumferential direction of the iron core 320.

When the armature 500 is moved to the initial position shown in FIGS. 2-4, the ball 700 is located in the first end 510*a* of the first curved groove 510. When the armature 500 is moved to the final position shown in FIG. 5, the ball 700 is located in the second end 510*b* of the first curved groove 510.

As shown in FIGS. 2 and 3, each second curved groove 410 has a depth gradually increasing from the first end 410*a* to the second end 410*b*. When the armature 500 is moved to the initial position shown in FIG. 4, the ball 700 is located in the first end 410*a* of the second curved groove 410. As shown in FIG. 5, when the armature 500 is moved to the final position, the ball 700 is located in the second end 410*b* of the second curved groove 410.

As shown in FIGS. 2-4, when the armature 500 is moved to the initial position, the first end 510*a* of the first curved groove 510 and the first end 410*a* of the second curved groove 410 are aligned with each other in the vertical direction Z to receive the ball 700, while the second end 510*b* of the first curved groove 510 and the second end 410*b* of the second curved groove 410 are separated from each other in the circumferential direction.

When the armature 500 is moved to the final position, as shown in FIG. 5, the second end 510*b* of the first curved groove 510 and the second end 410*b* of the second curved groove 410 are aligned with each other in the vertical direction Z to receive the ball 700, while the first end 510*a* of the first curved groove 510 and the first end 410*a* of the second curved groove 410 are separated from each other in the circumferential direction.

As shown in FIG. 4, when the armature 500 is moved to the initial position, there is a first air gap g1 between the armature 500 and the top plate 400, and a second air gap g2 between the upper iron core 320 and the lower iron core 310. As the armature 500 is moved from the initial position to the final position shown in FIG. 5, the first air gap g1 and the second air gap g2 are decreased gradually. As the armature 500 is moved from the final position to the initial position, the first air gap g1 and the second air gap g2 is increased gradually.

The upper iron core 320, the second air gap g2, the lower iron core 310, the magnetic yoke 100, the top plate 400, the first air gap g1, and the armature 500 form the main magnetic circuit of the electromagnetic system.

The coil 200, as shown in FIG. 1, has terminals 201, 202 adapted to be electrically connected to positive and negative electrodes of a power supply. When the coil 200 is energized, the magnetic flux generated by the coil 200 passes through the main magnetic circuit. Due to the presence of the first air gap g1 and the second air gap g2, the lower iron core 310 and the top plate 400 respectively attract the upper iron core 320 and the armature 500 downward in the vertical direction Z, so that while the upper iron core 320 and the armature 500 are driven to move downward in the vertical direction Z, the upper iron core 320 and the armature 500 are rotating around the central axis R under the push of the balls 700. The electromagnetic system may have larger torque and higher efficiency for a same size. In addition, the electromagnetic system has a simple structure and a very low manufacturing cost.

When the coil 200 is energized, while the armature 500 is moved from the initial position to the final position, the armature 500 drives the balls 700 to roll to the second ends 510*b*, 410*b* of the first curved groove 510 and the second curved groove 410 due to friction. When the armature 500 is moved to the final position, the coil 200 is de-energized so that the armature 500 may be moved from the final position to the initial position by a return spring.

When the coil 200 is de-energized, the residual magnetic flux rapidly decreases due to the presence of the second air gap g2, and the armature 500 will be quickly returned to the initial position by the return spring. At the same time, due to friction, the armature 500 drives the balls 700 to roll to the first ends 510*a* and 410*a* of the first curved groove 510 and the second curved groove 410.

As shown in FIG. 4, the coil 200 includes a support frame 220 and a wire 210 wound on the support frame 220. The upper iron core 320 and the lower iron core 310 are disposed in a hollow accommodation space of the support frame 220 of the coil 200, and the magnetic isolation ring 600 is supported on the upper end surface of the support frame 220 of the coil 200.

It should be appreciated for those skilled in this art that the above embodiments are intended to be illustrative, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. An electromagnetic system, comprising:

a magnetic yoke including a bottom wall, a sidewall extending a vertically from the bottom wall, and an open end opposite the bottom wall;

a coil mounted in the magnetic yoke and including a support frame and a wire wound on the support frame;

a lower iron core disposed in a lower portion of the coil and fixed to the magnetic yoke, the support frame of the coil and the lower iron core arranged directly on the bottom wall of the yoke;

a top plate disposed above the coil and directly fixed to the sidewall of the magnetic yoke and closing the open end;

an upper iron core having a lower portion disposed in the coil and an upper portion extending through the top plate;

an armature disposed above the top plate and fixedly connected to the upper iron core, a bottom surface of the armature having a plurality of first curved grooves, a top surface of the top plate having a plurality of second curved grooves corresponding to the first curved grooves;

a magnetic isolation ring disposed between the upper iron core and the top plate, and disposed between a bottom surface of the top plate and a top of the coil in a vertical direction parallel to a central axis of the upper iron core, the upper iron core configured to move in the vertical direction with respect to the magnetic isolation ring; and a plurality of balls each configured to roll in one of the first curved grooves and one of the second curved grooves, each first curved groove has a depth gradually deepening from a first end to a second end of the first curved groove, a force applied on the armature by the ball is inclined to the central axis of the upper iron core to drive the armature to rotate around the central axis.

2. The electromagnetic system of claim 1, wherein the armature is movable between an initial position and a final position, and as the armature is moved from the initial position to the final position, the armature is moved downward for a predetermined distance in the vertical direction and rotates for a predetermined angle around the central axis.

3. The electromagnetic system of claim 2, wherein the predetermined angle is equal to a sum of a central angle of the first curved groove and a central angle of the second curved groove.

4. The electromagnetic system of claim 2, wherein the ball is in the first end of the first curved groove when the armature is in the initial position and the ball is in the second end of the first curved groove when the armature is in the final position.

5. The electromagnetic system of claim 4, wherein each second curved groove has a depth gradually deepening from the first end of the second curved groove to the second end of the second curved groove.

6. The electromagnetic system of claim 5, wherein the ball is in the first end of the second curved groove when the armature is in the initial position and the ball is in the second end of the second curved groove when the armature is in the final position.

7. The electromagnetic system of claim 6, wherein the first end of the first curved groove and the first end of the second curved groove are aligned with each other in the vertical direction, and the second end of the first curved groove and the second end of the second curved groove are separated from each other, when the armature is in the initial position.

8. The electromagnetic system of claim 7, wherein the second end of the first curved groove and the second end of the second curved groove are aligned with each other in the vertical direction, and the first end of the first curved groove and the first end of the second curved groove are separated from each other, when the armature is in the final position.

9. The electromagnetic system of claim 8, wherein a first air gap is between the armature and the top plate and a second air gap is between the upper iron core and the lower iron core.

10. The electromagnetic system of claim 9, wherein the first air gap and the second air gap are decreased gradually as the armature is moved from the initial position to the final position, and the first air gap and the second air gap are increased gradually as the armature is moved from the final position to the initial position.

11. The electromagnetic system of claim 10, wherein the lower iron core, the upper iron core, the second air gap, the lower iron core, the magnetic yoke, the top plate, the first air gap, and the armature form a main magnetic circuit, when the coil is energized, a magnetic flux generated by the coil passes through the main magnetic circuit, the lower iron core and the top plate attract the upper iron core and the armature downward in the vertical direction to drive the upper iron core and the armature to move downward in the vertical direction and rotate around the central axis under the force of the balls.

12. The electromagnetic system of claim 11, wherein, when the coil is energized, the armature is moved from the initial position to the final position.

13. The electromagnetic system of claim 12, wherein, when the armature is moved to the final position, the coil is de-energized and the armature is moved from the final position to the initial position by a return spring.

14. The electromagnetic system of claim 1, wherein the coil includes a support frame distinct from the magnetic isolation ring, and a wire wound on the support frame, the support frame including an annular wall extending between the top of the coil and the bottom surface of the top plate, the magnetic isolation ring extending perpendicularly with respect to the central axis of the upper iron core and partially between the annular wall of the support frame and the bottom surface of the top plate.

15. An electromagnetic system, comprising:

a magnetic yoke;

a coil mounted in the magnetic yoke and including a support frame and a wire would on the support frame;

a lower iron core disposed in a lower portion of the coil and fixed to the magnetic yoke;

a top plate disposed above the coil and directly fixed to the magnetic yoke, an annular wall of the support frame of coil extending between a top of the coil and a bottom surface of the top plate;

an upper iron core having a lower portion disposed in the coil and an upper portion extending through the top plate;

an armature disposed above the top plate and fixedly connected to the upper iron core, a bottom surface of the armature having a plurality of first curved grooves, a top surface of the top plate having a plurality of second curved grooves corresponding to the first curved grooves;

a magnetic isolation ring, distinct from the support frame of the coil and disposed between the upper iron core and the top plate, and disposed between the bottom surface of the top plate and the top of the coil in a vertical direction parallel to a central axis of the upper iron core, the magnetic isolation ring extending perpendicularly with respect to the central axis of the upper iron core and partially between the annular wall of the support frame and the bottom surface of the top plate, the upper iron core configured to move in the vertical direction with respect to the magnetic isolation ring; and a plurality of balls each configured to roll in one of the first curved grooves and one of the second curved grooves, each first curved groove has a depth gradually deepening from a first end to a second end of the first curved groove, a force applied on the armature by the ball is inclined to the central axis of the upper iron core to drive the armature to rotate around the central axis, the upper iron core and the lower iron core are disposed in a hollow accommodation space of the support frame, and the magnetic isolation ring is supported on an upper end surface of the annular wall of the support frame opposing the bottom surface of the top plate.

16. The electromagnetic system of claim 1, wherein the first curved grooves are evenly spaced around the central axis of the upper iron core.

17. The electromagnetic system of claim 16, wherein a central axis of the plurality of first curved grooves coincides with the central axis of the upper iron core.

18. The electromagnetic system of claim 14, wherein the top plate is arranged directly over the support frame of the coil.

19. The electromagnetic system of claim 1, wherein the magnetic isolation ring includes a first portion disposed between the upper iron core and the top plate in a direction perpendicular to the central axis of the upper iron core, and a second portion extending perpendicularly from an end of the first portion and arranged between the coil and the bottom surface of the top plate.

20. An electromagnetic system, comprising:

a magnetic yoke including a bottom wall, a sidewall extending a vertically from the bottom wall, and an open end opposite the bottom wall;

a coil mounted in the magnetic yoke and including a support frame and a wire wound on the support frame;

a lower iron core disposed in a lower portion of the coil and fixed to the magnetic yoke, the support frame of the coil and the lower iron core arranged directly on the bottom wall of the yoke;

a top plate disposed above the coil and fixed to the sidewall of the magnetic yoke and closing the open end;

an upper iron core having a lower portion disposed in the coil and an upper portion extending through the top plate;

an armature disposed above the top plate and connected to the upper iron core, a bottom surface of the armature having a plurality of first curved grooves, a top surface of the top plate having a plurality of second curved grooves corresponding to the first curved grooves; and a plurality of balls each configured to roll in one of the first curved grooves and one of the second curved grooves, each first curved groove has a depth deepening from a first end to a second end of the first curved groove, a force applied on the armature by the ball is inclined to a central axis of the upper iron core to drive the armature to rotate around the central axis.

* * * * *